United States Patent [19]

Lamberts et al.

[11] 4,216,179

[45] Aug. 5, 1980

[54] PROCESS AND AN APPARATUS FOR THE CONTINUOUS MANUFACTURE OF BOARDS FROM MATERIAL INCORPORATING A HEAT HARDENABLE BINDER

[75] Inventors: Kurt Lamberts; Jürgen Leppin, both of Clausthal-Zellerfeld; Berndt Greten; Harry Neubauer, both of Springe, all of Fed. Rep. of Germany

[73] Assignee: Bison-werke Bähre & Greten GmbH & Co. KG, Springe, Fed. Rep. of Germany

[21] Appl. No.: 905,532

[22] Filed: May 12, 1978

[30] Foreign Application Priority Data

May 17, 1977 [DE] Fed. Rep. of Germany ..... 2722356

[51] Int. Cl.[2] ..... H05B 1/00

[52] U.S. Cl. ..... 264/25; 264/119; 264/120; 425/174; 425/335; 425/371

[58] Field of Search ..... 264/25, 120, 122, 119; 425/174, 335, 371

[56] References Cited

U.S. PATENT DOCUMENTS

| | | | |
|---|---|---|---|
| 3,230,287 | 1/1966 | Caron et al. | 264/120 |
| 3,942,929 | 3/1976 | De Mets | 425/335 |
| 4,005,162 | 1/1977 | Bucking | 264/25 |
| 4,111,744 | 9/1978 | Reiniger | 264/120 |

*Primary Examiner*—Donald J. Arnold
*Assistant Examiner*—James R. Hall

[57] ABSTRACT

Particleboard made from particles in the form of chips or fibers or the like is made by distributing a mass of chip material onto an endless belt conveyer system. The mass of material is subsequently passed to a precompressor, a high frequency preheating device, a further press and a finishing press. The unheated further press serves to reduce the thickness of the material to substantially that of the finished board prior to its consolidation by temperature and pressure in the finishing press. A further endless belt contacts the surface of the material and runs through the precompressor, the high frequency heating device and the further press and serves to counteract any tendency of the chip material to expand after leaving the precompressor. This endless belt additionally yields a number of other significant advantages, in particular a reduction of loss of heat from the material prior to reaching the finishing press.

12 Claims, 1 Drawing Figure

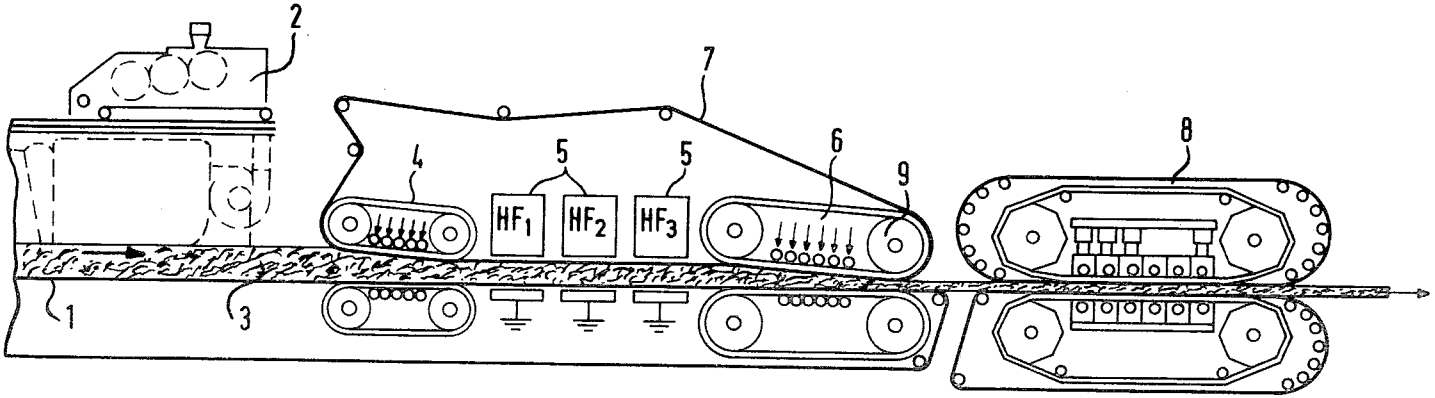
8
9
6
7
5
HF3
5
HF2
HF1
4
2
3
1

PROCESS AND AN APPARATUS FOR THE CONTINUOUS MANUFACTURE OF BOARDS FROM MATERIAL INCORPORATING A HEAT HARDENABLE BINDER

The present invention relates to a method and apparatus for the continuous manufacture of particleboards consisting of a material which includes a heat hardenable binding medium; and has particular reference to the manufacture of particleboards such as chipboard or fibreboard in which a mass of chips or other material particles is continuously moved along on an endless belt conveyer system. The material, after being subjected to a degree of precompression, is fed through a high frequency preheating zone and is finally brought into the desired hardened state through the use of contact heat and pressure.

It is known from West German Printed Patent Publication Number 21 13 763 that the heating of a mass of this type of material can be made easier by the use of high frequency energy and that the occurence of voltage break downs can be avoided when the mass of material is subjected to a pressing procedure before entering the high frequency heating zone; this allows a uniform thickness and structure of the material to be obtained. The uniformity of thickness and structure is brought about by means of a precompressor which is arranged before the high frequency heating device and which comprises two endless belts and pressure rollers and which in general reduces the height of the mass to the final desired thickness of the particleboard.

The object of the present invention is to fashion the previously defined kind of process into an economical form which yields a higher quality of particleboard and will result in a considerable reduction of the process time.

This problem is solved by the invention in that, after preheating the material by means of high frequency energy and before the application of contact heating, a continuous pressing of the material takes place utilizing a relatively high pressure in comparison with that used in said precompression process and that the material is generally brought to the necessary final thickness of the particleboard during this prepressing process. While it has previously been attempted to compress the material before the high frequency heating to a thickness close to the final thickness of the board and to place the finishing press in general directly after the high frequency heating station, the present invention enables a precompression step after which the high frequency heating takes place to be combined with a further pressing step which makes it possible to obtain a material pressed at least substantially to the size of the finished board.

Because of the increased thermal conductivity of the precompressed and further pressed chip material the material is more quickly warmed through in the finishing press so that the amount of time the material stays in the press zone can be shortened. Hence it is possible to raise the quantity of board produced by the finishing press by increasing its speed which results in an overall increase of the output of the installation. Alternatively, the length of the finishing press necessary to maintain the same output can be reduced. Furthermore the advantage is obtained that, except when using raw material with relatively low bulk density, very thick boards can be manufactured with making special adaptions to the entry region of the continuous finishing press necessary. Furthermore the mechanical stress on the continuous finishing press is reduced so that it can be of simpler construction.

An advantageous embodiment of an apparatus for carrying out the process of the invention comprises an endless band conveyer onto which the material is distributed in the desired arrangement at a forming station. The apparatus then includes an arrangement for continously precompressing the material, at least one high frequency heting device and also a heatable continuously working finishing press. The apparatus specifically features a continuously operating further press arranged between the high frequency heating device and the finishing press and an endless belt of a non-metallic material of a width corresponding to the width of the material which exerts a relatively small pressure on the material and is fed through the precompressor, the high frequency heating device and the further press.

The endless belt, which is preferably made of a synthetic material brings about, in combination with the precompressor, the high frequency heating device and the further press, a series of advantages.

By means of the synthetic belt lying on the material in the high frequency zone a reduction of the energy supplied to the material through the high frequency field due to undesired evaporation processes is prevented. Such evaporation processes would otherwise bring about a significant loss of energy at the temperatures achieved in the preheating zone because of the comparatively very high latent heat of evaporation of water and the large active surface of a non-covered chip-structured material. In this manner the danger of electrical break down due to the formation of water droplets from the condensation of steam is additionally avoided.

Because of the fact that the material in the further press which follows the high frequency heating device is more strongly compressed than in the precompressor, the endless belt which also runs through the press produces, especially in and in the vicinity of the high frequency heating zone, a compression of the upper surface of the material which smooths the surface and thus leads to an improvement in the quality of the surface of the board.

The endless belt which is strained against the material has also the effect of counteracting a tendency of the material to expand after leaving the precompressor and makes it possible to operate with a very small air gap in the high frequency heating device. A smaller air gap and an increase of the density of the material furthermore reduces the electrical Q factor of the operating capacitor associated with the high frequency heating device and thereby raises the efficiency of the high frequency heating device.

The endless belt also has an insulating function with reference to the further press because it prevents a part of the heat supplied to the material in the high frequency heating device being lost to the unheated further press. The insulating function of the endless belt in the further press guarantees in an appropriately advantageous manner that the material does not loose a significant quantity of energy on its way from the high frequency heating device to the finishing press.

Preferably a roller press is used both for the precompressor and also for the further press and both roller presses are unheated.

Further advantages brought about by the invention include the fact that it is made possible for the relatively high stability of the mass of material brought about in the further press to be passed on to the finishing press without the danger of structural damage occuring to the mass of material. Because of the chosen preheating of the mass of material, the easier formability in the further press means that a board material of especially high density with raised strength characteristics can be manufactured.

An embodiment of the invention will now be described by way of example only and with reference to the accompanying drawing which shows a schematic illustration of an installation for the continuous manufacture of chip-board, fibre-board, hard-board or the like.

In the drawing there can be seen part of an endless belt or band 1 which passes over guide rollers and drive rollers (not shown) and which moves continuously in the direction of the indicated arrow so as to forward a mass of chip material through the installation.

Above the band 1 there is shown a schematically illustrated forming station 2 which distributes a mixture of particles of a material containing ligno cellulose and a dispersed binding medium supplied to the forming station onto the band 1. This process preferably operates in accordance with the known air sifting process. In principle any desired suitable forming station can be used. The mass of material formed on the endless band 1 is referred to in the art as the mat.

The distributed mass of material 3 then runs through a precompressor 4 the construction of which can likewise be as desired but which must however guarantee that the mass of material is brought to an even level and is reduced in thickness by at least one third. Preferably the precompressor brings about a somewhat more pronounced compression.

After the precompression the mass of material is fed into a high frequency heating device which in the illustrated embodiment comprises three separate and preferably similarly constructed arrangements designated HF1, HF2 and HF3 respectively. Within the high frequency heating device 5 the mass of material is preheated by high frequency energy so that, with the presence of a plurality of the high frequency heating units, the middle regions of the mass of material can be heated to 50° C. or 70° C. and indeed to higher temperatures.

After passing through the high frequency heating device 5 the preheated mass of material reaches a further press 6 in which it is strongly compressed so that the mass of material leaving the further press 6 already has approximately the final end thickness of the board.

An essential feature of the invention resides in the provision of a further endless belt 7 a part of which is fed in a tightly stretched state through the precompressor 4, the heating device 5 and the further press 6. This endless belt 7 which is preferably made of a synthetic material is taken along, i.e. set in motion by, an output rolier 9 of the further press 6 so that it has of necessity the desired synchronous movement with the mass of material and the endless belt 1.

The multiple functions of the further endless belt 7 have already been described but it is especially clearly recognizable from the drawing that the clamping effect i.e. the desired pressing of the belt 7 on the mass of material 3 especially in the high frequency heating device 5, is so improved, that a considerably more pronounced compressing of the mass of material takes place in the further press 6 than in the precompressor 4. This desired clamping effect being obtained by holding the endless belt 7 closer to the endless belt 1 in the vicinity of the output slot of the further press 6 than it is in the vicinity of the entry to the high frequency heating device.

The mass of material leaving the further press 6 is already strongly compressed and already has a comparatively high stability before it enters the finishing press 8. In the finishing press respective endless recirculating steel bands are led around an upper hydraulically braced chain of steel plates and a lower rigidly supported chain of steel plates. Both the endless chains of steel plates and the endless steel bands are heated during their circulation by gas surface burners and/or electrical induction heating means so that a temperature of approximately 200° C. is achieved at the entry to the press. In the subsequent pressing procedure the heat is transferred to the pressed material. During this time no other heat is supplied to the press. The entire pressure and heating surfaces have three regions. In the first the high pressure region, the compression of the material to the desired thickness takes place. In the subsequent middle pressure region the binding material hardens at a relatively low pressure which is made sufficient to hold the thickness of the board constant and finally in the exit zone of the press the pressure is reduced to zero.

With an installation of the schematically illustrated kind it is possible to manufacture chip board 16 mm thick with a speed of advance of 12 m/min and 19 mm thick chip board with a speed of 11 m/min which, with of board of 1300 mm width, which means a production capacity of up to 500 $m^3$/day can be achieved depending on the thickness of the board. These figures are however not to be regarded in any way as a limitation of the capabilities of the process.

The inventive principle of this kind of high frequency warming makes it generally suitable for heating relatively poorly electrically conducting materials such as materials containing ligno cellulose and/or cellulose and preferably provided in the form of a fleece of the material in the form of layers, tracks, balls or the like.

Various further modifications to the apparatus are possible, in particular it has been found useful for the speed of operation of the finishing press to be controlled in dependence on the speed of the further press.

We claim:

1. A process for the continuous manufacture of particleboard comprising the steps of:

(a) forming a mat of lignocellulosic particles admixed with a heat hardenable binder binder in a forming station, (b) forwarding said mat by endless belt means to a precompressor adapted to produce a precompressed mat of even level and reduced in thickness by approximately one third, (c) forwarding the precompressed mat via the endless belt means to a high frequency energy preheating device for warming the mat to improve the compressibility thereof, (d) forwarding the precompressed and warmed mat via the endless belt means to a further press for effecting a further pressing of the mat to reduce its thickness to substantially that of the required particleboard, said further pressing being effected at a pressure relatively high in relation to the pressure used in the precompressor and (e) subsequently passing the compressed mat to a finishing press for consolidation into the final particleboard by the application of pressure and heat to harden the binder without substantial further reduction in thickness.

2. A process for the continous manufacture of particleboard comprising the steps of:

(a) forming a mat of lignocellulosic particles admixed with a heat hardenable binder on endless belt means in a forming station, (b) sandwiching said mat between said endless belt means and a further endless belt of non-metallic material and which runs through a precompressor, a high frequency energy heating device and a further press, (c) forwarding said mat sandwiched between said endless belt means and said further endless belt to said precompressor whereby to produce a precompressed mat of even level and reduced in thickness by approximately one third, (d) forwarding said precompressed mat sandwiched between the endless belt means and the further endless belt to said high frequency preheating device for warming the mat to improve the compressibility thereof and wherein the further endless belt in cooperation with the endless belt means exerts a relatively small pressure on the mat during its passage from the precompressor through the high frequency heating device whereby to counteract the tendency of the mat to expand after leaving the precompressor, (e) forwarding the precompressed and warmed mat sandwiched between the endless belt means and the further endless belt to said further press for effecting a further pressing of the mat to reduce its thickness to substantially that of the required particleboard, said further pressing being affected at a pressure relatively high in relation to the pressue used in the precompressor and (f) subsequently passing the compressed mat to a finishing press for consolidation into the final particleboard by the application of pressure and heat to harden the binder without substantial further reduction in thickness.

3. Apparatus suitable for the continuous manufacture of particleboard, the apparatus comprising: a forming station for forming a mat of lignocellulosic particles admixed with a heat hardenable binder binder on endless belt means being arranged to forward the mat in flow series to a precompressor, adapted to precompress the mat to an even level and to reduce its thickness by approximately one third; to a high frequency energy preheating device for raising the temperature of the mat to improve the compressibility thereof; to a further press for reducing the thickness of the mat to substantially the thickness of the final particleboard and to a finishing press for consolidating the mat into the final particleboard by the application of pressure and heat to harden the binder.

4. Apparatus according to claim 3 and in which both the precompressor and the further press are unheated.

5. Apparatus suitable for the continuous manufacture of particleboard, the apparatus comprising: a forming station for forming a mat of lognocellulosic particles admixed with a heat harderable binder binder on endless belt means, the endless belt means being arranged to forward the mat in flow series to a precompressor, adapted to precompress the mat to an even level and reduce its thickness by approximately one third; to a high frequency energy preheating device for raising the temperature of the mat to improve the compressibility thereof; to a further press for reducing the thickness of the mat to substantially the thickness of the final particleboard and to a finishing press for consolidating the mat into the final particleboard by the application of pressure and heat to harden the binder, there being additionally provided a further endless belt of a width corresponding to the width of the mat and of a non-metallic material, said further endless belt passing through at least said precompressor, said high frequency heating device and said further press and moving at substantially the same speed as the endless belt means and being adapted to exert a relatively small pressure on the surface of the mat opposite to the surface contacting the endless belt means during passage of the mat between said precompressor and said further press.

6. Apparatus according to claim 5 and in which at least the portion of the endless belt passing from the precompressor to the further press is maintained under tension whereby substantially to counteract the tendency of the mat to expand after leaving the precompressor.

7. Apparatus according to claim 6 and in which the endless belt comprises a synthetic material reinforced by a web.

8. Apparatus according to claim 6 and in which said endless belt comprises a web of woven material.

9. Apparatus according to claim 8 and in which said endless belt comprises a web of relatively fine weave.

10. Apparatus according to claim 6 and in which the endless belt is driven by an output roller of the further press.

11. Apparatus according to claim 6 and in which the speed of operation of the finishing press is controlled in dependence on that of the further press.

12. Apparatus according to claim 5 in which said further press comprises a roller press incorporating a series of sequentially disposed rollers, the output gap of which corresponds substantially to the final desired thickness of said particleboard.

* * * * *